US006364502B1

(12) United States Patent
Johnson

(10) Patent No.: US 6,364,502 B1
(45) Date of Patent: Apr. 2, 2002

(54) VANITY LIGHT FIXTURE

(75) Inventor: Aaron Mitchell Johnson, Fort Worth, TX (US)

(73) Assignee: Quorum International, L.P., Forth Worth, TX (US)

( * ) Notice: Subject to any disclaimer, the term of this patent is extended or adjusted under 35 U.S.C. 154(b) by 0 days.

(21) Appl. No.: 09/478,167

(22) Filed: Jan. 5, 2000

(51) Int. Cl.[7] ..... A47B 23/06

(52) U.S. Cl. ..... 362/127; 362/132; 362/249; 362/252; 362/338; 362/431

(58) Field of Search ..... 362/127, 132, 362/370, 249, 252, 235, 431, 432, 338

(56) References Cited

U.S. PATENT DOCUMENTS 1,831,443 A * 4/1931 Goldman ..... 362/252
3,978,529 A 9/1976 Krafft ..... 4/2
4,998,188 A 3/1991 Degelmann ..... 362/147
5,199,782 A 4/1993 Johnson et al. ..... 362/147

* cited by examiner

*Primary Examiner*—Sandra O'Shea
*Assistant Examiner*—Beatrand Zeade
(74) *Attorney, Agent, or Firm*—Kenneth C. Hill; Hill & Hunn LLP

(57) ABSTRACT

A lighting fixture suitable for use in a bathroom, vanity, or similar application includes an extended fixture with multiple light bulbs. The light bulbs are spaced from the fixture in such a manner that the bulbs do not lie on a single line. The back plate may have a curving portion for supporting the bulbs in a non-linear manner, or individual spacers of different lengths may be used to project the bulbs different distances from a planar backplate.

7 Claims, 2 Drawing Sheets

VANITY LIGHT FIXTURE

BACKGROUND OF THE INVENTION

1. Field of the Invention

The present invention relates generally to lighting fixtures, and more specifically to a multiple bulb fixture suitable for use in bathrooms, vanities, and the like.

2. Description of the Prior Art

Lighting fixtures for use in bathrooms and vanities, are available in a number of designs. One of the overall goals of any such design is to provide illumination such that a person is able to get a relatively clear look at their face, hair, and other body parts. A wide variety of fixture designs have been used in an attempt to provide appropriate lighting.

One basic fixture design is often referred to in the industry as a "bath bar" or "vanity bar." This fixture design consists of an extended bar having, typically, three to six individual lights projecting from the front. The bar can be placed over a mirror to provide lighting to those standing in front of the mirror.

The individual lights connected to the bar vary widely in type. They can be, for example, simple spherical light bulbs, typically frosted or clear, which are screwed into light sockets. They may also be more complicated fixtures, typically involving bulbs oriented in a vertical direction and partially covered by a glass shade. The shade may be frosted or partly frosted, and decoratively shaped to match any desired décor. The light bulb used in such an arrangement may be a normal bulb, or a specially designed decorative bulb.

Other approaches to bathroom and vanity fixtures have included placement of lights vertically along the side of a mirror, placement of lights in the ceiling above the mirror, and various combinations of these and other designs.

As yet, the single, elongated vanity bar design remains very popular, but does not always provide the lighting pattern desired. It would be desirable to provide improvements in such a lighting fixture.

SUMMARY OF THE INVENTION

In accordance with the present invention, a lighting fixture suitable for use in a bathroom, vanity, or similar application includes an extended fixture with multiple light bulbs. The light bulbs are spaced from the fixture in such a manner that the bulbs do not lie on a single line. The back plate may have a curving portion for supporting the bulbs in a non-linear manner, or individual spacers of different lengths may be used to project the bulbs different distances from a planar backplate.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
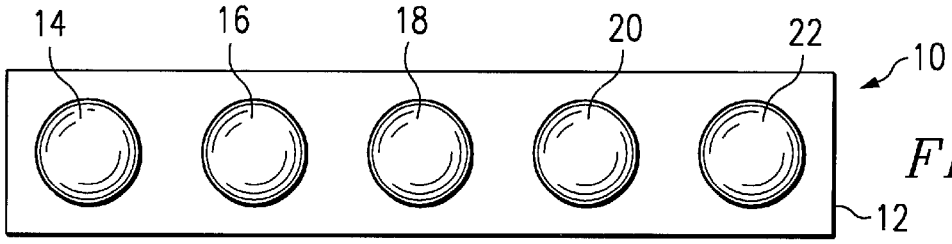
FIG. 1 is a front view of a vanity bar light fixture in accordance with the present invention.

As will be appreciated by those skilled in the art, individual lights are mounted to vanity bars and similar fixture elements with a wide variety of supporting arms, shades, and so forth. In the drawings, the bulbs are shown attached to a vanity bar using simple cylindrical projecting arms which contain light bulb sockets, with spherical bulbs being screwed into these sockets. However, it will be understood that many different types of decorative arms may be used with the present invention.

Referring to FIG. 1, a preferred vanity bar lighting fixture 10 includes a backplate 12. Backplate 12 is illustrated as a rectangular backplate, but any decorative backplate can be used with the present invention.

Backplate 12 typically varies in length between approximately two feet and four feet, depending upon the number of bulbs to be included with the fixture. Common backplate dimensions are also two inches to six inches in height and typically less than two inches in thickness.

Fixture 10 includes five bulbs, 14, 16, 18, 20, 22. It will be understood by those skilled in the art that a different number of bulbs can be used as desired. Also, as described above, although decorative, spherical bulbs are shown in the drawings, other types of fixtures and bulbs can also be used.

Figure 2:
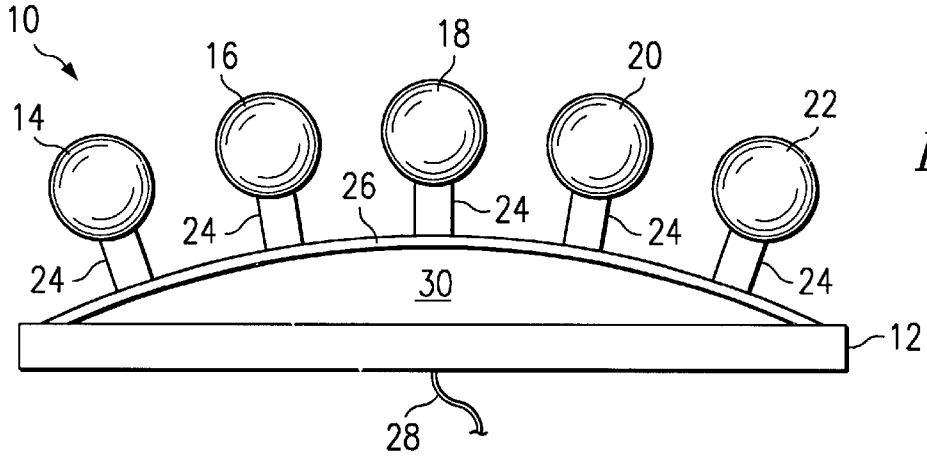
FIG. 2 is a top view of a preferred vanity bar light fixture in accordance with the present invention.

FIG. 2 is a top view of lighting fixture 10. Bulbs 14–22 are mounted on decorative arms 24 which are, in this embodiment, cylindrical shrouds covering wires, socket, and mounting hardware (not shown) for the corresponding bulb. Decorative shrouds 24 are conventional, and are attached to a curved element 26 in a conventional manner.

Curved element 26 is preferably hollow, and attached to backplate 12 at the ends. Element 26 is used for mounting and supporting the shrouds 24, and as a passageway for electrical wiring (not shown) which runs from each socket to an external power cable 28. The power cable 28 exits from the back of backplate 12, with the various wires for each socket being wired together in parallel within the backplate 12.

As shown, curved member 26 is attached to backplate 12 only at the ends, leaving a gap 30 between curved member 26 and backplate 12. However, if desired, the backplate can have a protruding front which approximates the curve of curved member 26, so that the region between the front portion of curved member 26 and the back side of backplate 12 is an enclosed space in which wires and connectors can be run.

As shown in FIG. 2, shrouds 24 are each bolted to curved member 26 in an identical manner, so that each shroud 24 projects at a right angle from the surface of curved member 26, giving a different angle with relation to the plane of backplate 12. Another approach for attaching shrouds to the curved member 26 is shown in FIG. 3.

Figure 3:
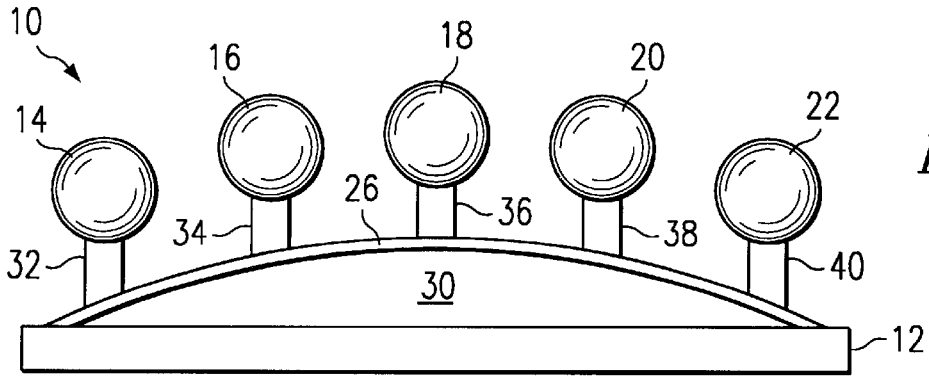
FIG. 3 is a first alternative embodiment of a vanity bar light fixture in accordance with the present invention.

In FIG. 3, shrouds 32, 34, 36, 38 and 40 are attached to curved member 26 so as to support lights 14–18 respectively. In the embodiment of FIG. 3, shrouds 32–40 are parallel, each projecting approximately 90° away from the plane of backplate 12. This is accomplished by one of two methods. In the first, flat regions (not shown) can be provided on the curved member 26, so that identical shrouds 32–40 can be used. In a second approach, each of the shrouds 32–40 can be manufactured so as to have an angled side where they are attached to curved member 26. The angle of each shroud is matched to the curvature of member 26 so that the center line of the cylindrical shroud is perpendicular to backplate 12.

If the shrouds are simple cylinders, identical shrouds can be used on opposite ends. Thus, for example, shroud 32 can be identical to shroud 40, with the shrouds installed with an orientation 180° from each other. In a similar manner, shrouds 34 and 38 can be identical.

If lighting fixtures are used which are not simple cylinders such as shrouds 32–40, other arrangements may be necessary if it is desired that the individual fixtures are parallel in a manner similar to that shown in FIG. 3.

Figure 4:
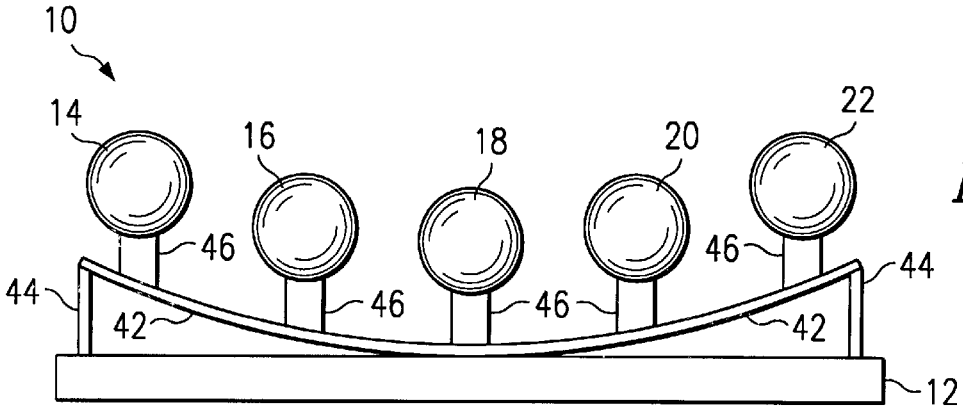
FIG. 4 is a second alternative embodiment of a vanity bar light fixture in accordance with the present invention.

In FIG. 4, another alternative embodiment is shown. In this embodiment, a curved member 46 is provided which curves closer to the backplate 12 in the middle, and extends further on the ends where it is supported by brackets 44. In a manner similar to that described in connection with FIG. 3, shrouds 46 are preferably connected to curved member 42 so that each light projects essentially perpendicularly with respect to the plane of backplate 12. If desired, shrouds 46 can be connected to curved portion 42 so that they are each at right angles to curved portion 42 at the point where they meet, which would cause all light bulbs to project somewhat toward a common central point. The arrangement shown in FIG. 4 may be more aesthetically pleasing, however.

Figure 5:
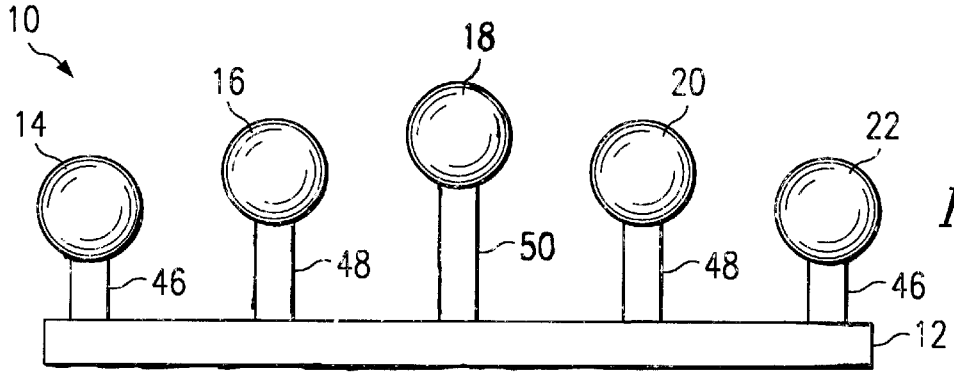
FIG. 5 is a third alternative embodiment of a vanity bar light fixture in accordance with the present invention.
Figure 6:
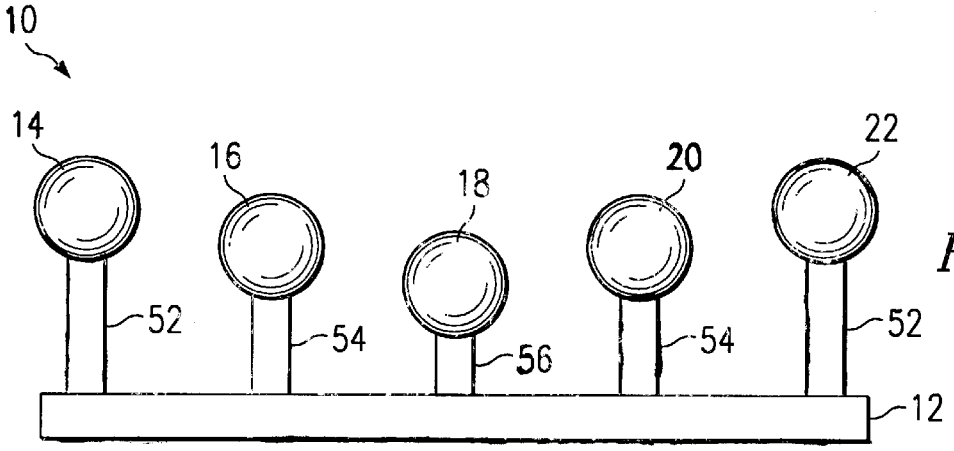
FIG. 6 is a fourth alternative embodiment of a vanity bar light fixture in accordance with the present invention.
Figure 7:
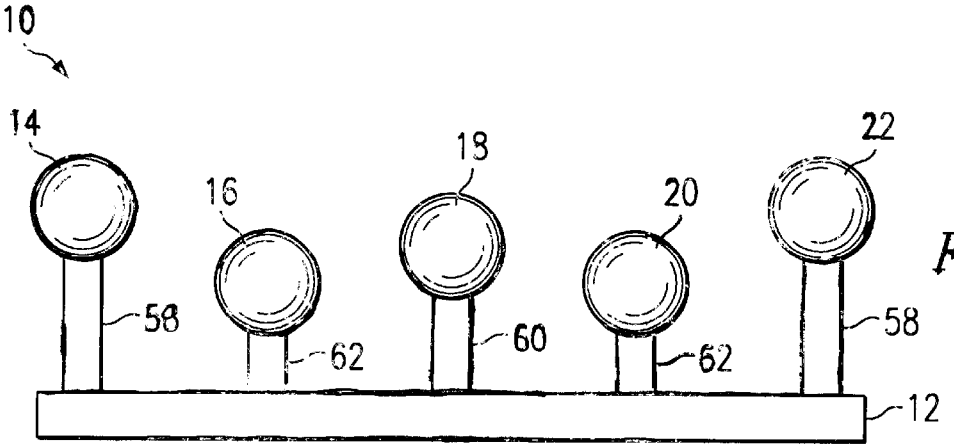
FIG. 7 is a fifth alternative embodiment of a vanity bar light fixture in accordance with the present invention.

FIGS. 5, 6 and 7 are directed to alternative embodiments in which the shrouds are connected directly to a substantially planar backplate, but are different lengths to give various positioning effects to the lights themselves.

Referring to FIG. 5, end supports 46 at each end of backplate 12 are relatively short, with medium length supports 48 toward the middle, and a longer support 50 supporting middle light 18. This gives a pattern for the lights similar to that of FIGS. 2 and 3.

Referring to FIG. 6, end supports 52 are the longest, with intermediate length supports 54 and shortest support 56 progressing toward the middle of backplate 12. This gives a location for lights similar to that of FIG. 4.

FIG. 7 illustrates an embodiment which has longest supports 58 on either end of backplate 12. An intermediate length support 60 is located in the middle, with shorter supports 62 between the middle and ends of the backplate 12. As will be apparent to those skilled in the art, various arrangements of varying length supports can be used in addition to the pattern shown in FIG. 7.

The embodiments shown in FIGS. 5–7 involve varying length supports which are connected to the backplate 12. This requires supports of more than one length to be manufactured, but does not involve attachment of an extra curved member such as member 26 shown in FIG. 2. The variable length supports of FIGS. 5–7 can, of course, be used in concert with curved supports or fronts such as curved support 26 to achieve many different types of non-linear lighting patterns.

While the invention has been particularly shown and described with reference to a preferred embodiment, it will be understood by those skilled in the art that various changes in form and detail may be made therein without departing from the spirit and scope of the invention.

What is claimed is:

1. A vanity bar light fixture, comprising:

an elongate backplate having a substantially planar first front surface and two ends, the backplate adapted to mount on a wall over a mirror;

a curved front member having a second front surface and having two ends, each end attached to the backplate near a corresponding backplate end so that the curved front member extends horizontally in front of the backplate, wherein a middle portion of the curved front member is spaced from the backplate front surface to define an uncovered gap therebetween; and a plurality of supports attached to the second front surface, wherein each support is adapted to hold a light emitting source in a spaced relationship to the second front surface.

2. The decorative light fixture of claim 1, wherein each support holds its light emitting source the same distance from the second front surface.

3. The decorative light fixture of claim 1, wherein each support extends from the second front surface in a direction perpendicular to the second front surface from each point of attachment.

4. The decorative light fixture of claim 1, wherein each support extends from the second front surface in a direction which is perpendicular to the first front surface.

5. The vanity bar of claim 1, wherein the front member middle portion is spaced further from the backplate front surface than the front member ends.

6. The vanity bar of claim 1, wherein the front member ends are spaced further from the backplate front surface than the front member ends.

7. A vanity bar light fixture, comprising:

an elongate backplate having a substantially planar first front surface and two ends, the backplate adapted to mount on a wall over a mirror;

a plurality of supports attached to the backplate front surface, wherein each support is adapted to hold a light emitting source in a spaced relationship to the backplate front surface, and wherein at least two such supports have a length different from each other, wherein the light emitting sources held by such arms are spaced different distances from the backplate front surface.

* * * * *